United States Patent [19]

Matievich

[11] Patent Number: 4,674,217

[45] Date of Patent: Jun. 23, 1987

[54] FIREARM WITH REVERSIBLE BARREL

[76] Inventor: Michael Matievich, 380 Pennsylvania Ave., Wilmerding, Pa. 15148

[21] Appl. No.: 864,429

[22] Filed: May 19, 1986

[51] Int. Cl.[4] ..... F41C 21/00; F41C 21/12; F41C 21/22

[52] U.S. Cl. ..... 42/76.01; 42/75.02; 42/77

[58] Field of Search ..... 42/75.02, 76.01, 77, 42/79

[56] References Cited

U.S. PATENT DOCUMENTS 4,494,332 1/1985 Matievich ..... 42/77

FOREIGN PATENT DOCUMENTS 730030 12/1942 Fed. Rep. of Germany .
279655 3/1952 Switzerland .

*Primary Examiner*—Deborah L. Kyle
*Assistant Examiner*—Ted L. Parr
*Attorney, Agent, or Firm*—Clifford A. Poff; Thomas H. Murray

[57] ABSTRACT

For firing bullets or cartridges of different lengths but the same caliber, there is provided a barrel which is threaded at both ends and reversible, with different-length bores in each end. There is desirably also a protective cap for the threads at the distal end of the firearm, and also, at each end of the barrel, a lug or projection with opening therein to aid in securing the reversible barrel onto the part of the firearm proximal to the user.

4 Claims, 1 Drawing Figure

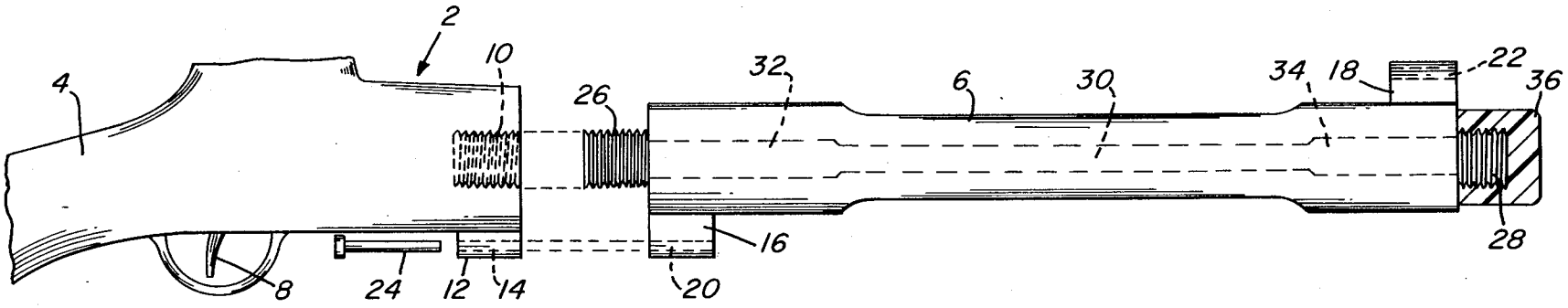
36
22
28
18
34
30
6
32
16
20
26
10
14
2
12
24
8
4

FIREARM WITH REVERSIBLE BARREL

BACKGROUND OF THE INVENTION

1. Field of the Invention

This invention relates to firearms, in particular, to a firearm which is capable of firing different-size cartridges.

2. Description of the Prior Art

One known way of providing a firearm which is capable of firing different-size cartridges is shown in U.S. Pat. No. 4,494,332. In the structure disclosed in the patent, there is disclosed a block which has therein a number of bores which are adapted to receive, for example, cartridges which are of the same caliber but of different lengths, each bore containing in a part distal from the user an internally threaded part for receiving screwingly the proximal end of the barrel of the firearm. The barrel is shown as being threaded only on one end, but it is capable of being brought into engagement with the desired one of the bores, in accordance with the size of the cartridge to be fired. With the structure according to U.S. Pat. No. 4,494,332 it is necessary, when changing the size of the cartridge to be fired, not only to remove the barrel from one bore end and insert it into another, but also to rotate the block containing the bores so that a desired and appropriate one is brought into alignment with the apparatus for delivering into a suitably fitting bore the cartridge which is to be fired. There has been a need in the art for a structure which will accomplish the same result with less weight and with less manipulation, when changing from one cartridge size to another.

There exist in the prior art some examples of a rifle barrel having external threading at each end of the barrel. Such barrels can be seen, for example, in German Pat. No. 730,030, issued in 1943, and in Swiss Pat. No. 279,655, published in 1952. These patents lack, however, both the idea of providing different-length enlarged bores in the opposite ends of the barrel and the idea of considering the barrel reversible, i.e., such that either one end or the other thereof may be used as the proximal portion of the rifle barrel, in accordance with the length of the ammunition which is desired to fire.

SUMMARY OF THE INVENTION

For firing bullets or cartridges of different lengths but the same caliber, there is provided a barrel which is threaded at both ends and reversible, with different-length bores in each end. There is desirably also a protective cap for the threads at the distal end of the firearm, and also, at each end of the barrel, a lug or projection with opening therein to aid in securing the reversible barrel onto the part of the firearm proximal to the user.

DESCRIPTION OF THE DRAWINGS

A complete understanding of the invention may be obtained from the foregoing and following description thereof, taken in conjunction with the appended drawing, the sole FIGURE whereof illustrates a firearm in accordance with the invention.

DESCRIPTION OF THE PREFERRED EMBODIMENT

In the drawing, there can be seen a firearm 2 which includes a breech portion 4 proximal to the user and a reversible barrel 6. The portion 4 includes a trigger 8, and it contains means (not shown) for delivering ammunition to a part of the portion 4 which is internally threaded, as at 10.

Preferably, the portion 4 also includes a lug 12 having therein a bore or passage 14, which serves the purpose of cooperating with either the lug 16 or the lug 18 of the reversible barrel 6. The above-mentioned lugs 16 and 18 are provided with passages or bores 20 and 22, respectively, which serve together with the bolt 24 to aid in fastening the barrel 6 to the proximal portion 4 of the firearm.

The reversible barrel 6 has at its proximal and distal ends, respectively, exteriorly threaded portions 26 and 28, each of which is of such dimensions as to engage matingly with the interiorly threaded portion 10 of the portion 4 of the firearm.

The barrel 6 has a central portion 30 in which it is provided with a bore which corresponds to the caliber of the ammunition to be fired therethrough, and it also has, at first and second opposite ends thereof, bore portions 32 and 34 which are of enlarged diameter in comparison with the diameter of the bore in the central portion 30 of the reversible barrel 6 which base portions form cartridge chambers. Moreover, in order to enable the apparatus to accommodate the use of cartridges which are different in overall length, the enlarged bore portions 32 and 34 are different in length, each having a length suiting it for the reception of one or the other of the two cartridge-length sizes which may be accommodated with the use of apparatus according to the present invention. In the drawing, it can be seen, for example, that the portion 32 is somewhat longer than portion 34.

It will be understood that the exteriorly threaded portions 26 and 28 each also contain interiorly thereof suitable extensions of the bore portions of enlarged diameter 32 and 34, respectively.

For protecting the threads of the portion 28, when the firearm is not in use and the exterior threads 26 have been engaged in the interiorly threaded portion 10 of the portion 4 of the firearm, there is provided a cap member 36, which may be of plastic or of any other suitable material. Preferably, the cap member 36 is interiorly threaded.

To assemble the firearm with reversible barrel, according to the invention, for the firing of longer cartridges, the threaded portion 26 is caused to engage with the threaded portion 10 and the proximal part 4 of the firearm, and the lug 16 is brought against the lug 12, with the openings 14 and 20 in the lugs 12 and 16 brought into alignment, so that by the insertion of the bolt 24, the reversible barrel portion 6 may be additionally secured to the stock portion 4 of the firearm. The bolt 24 may be threaded, and engaging with threads in the portions 14 and 20 of the lugs 12 and 16, respectively, where the bolt 24 may be threaded, to engage the threads in the portion 20 of the lugs 16 or both of the portions 14 and 20 may be unthreaded and the bolt 24 may be used in connection with a nut (not shown).

In order to make the firearm of the invention suitable for firing cartridges of shorter length but of the same caliber, the bolt 24 is undone, and the reversible barrel portion 6 is unthreaded out of the opening 10, reversed end-for-end to bring the threaded portion 28 into engagement with the threaded portion 10 (the protective cap 36 having been removed), and then, with the lug portion 18 in alignment with the lug 12 to bring the bore 22 into registry with the bore 14, the bolt 24 is inserted, to secure the reversible barrel 6 in position with the somewhat shorter bore portion 34 adjacent to the proximal portion 4 of the firearm 2. Apparatus of the kind described above makes it possible to obtain the same effect as is obtained with the apparatus of U.S. Pat. No. 4,494,332, but with the use of equipment of lighter weight and greater simplicity.

While I have shown and described herein a certain embodiment of my invention, I intend to cover as well any change or modification therein which may be made without departing from its spirit and scope.

In view of the foregoing, one skilled in the art will now understand that the construction of parts to permit use of a reversible barrel according to the present invention may be applied to a hand gun, particularly a pistol, as well as a rifle.

I claim:

1. The combination with a breech part of a firearm in which there is provided an interiorly threaded bore, to and through which cartidges to be fired by said firearm may be passed, of a reversible barrel part which has a central bore position corresponding in diameter to the caliber of said cartridges, and at first and second opposite ends of said reversible barrel part, first and second cartridge chambers of enlarged diameter in respect to said diameter of said central bore but different overall lengths, said reversible barrel part having at each end thereof an exteriorly threaded portion capable of being threadly secured to said interiorly threaded in said breech part of said firearm.

2. A combination as definded in claim 1, wherein said combination further comprises an interiorly threaded removable cap for protecting the exteriorly threaded portion of said reversible barrel part distal to said breech part.

3. A combination as defined in claim 1, wherein said reversible barrel part has at said first and second opposite ends thereof a pair of projecting lugs, each having an opening therethrough, and means on said breech part comprising a lug with opening therethrough and bolt means cooperating therewith for securing said reversible barrel part to said breech part of said firearm.

4. A combination as defined in claim 3, wherein said combination further comprises an interiorly threaded removable cap for protecting the exteriorly threaded portion of said reversible barrel part distal to said breech part.

* * * * *